US005337590A

United States Patent [19]

Schuchert et al.

[11] Patent Number: 5,337,590

[45] Date of Patent: Aug. 16, 1994

[54] METHOD AND APPARATUS FOR BENDING TUBES USING SPLIT BEND DIE

[76] Inventors: Eugene H. Schuchert, 1814 Hafor Dr., Iowa City, Iowa 52246; David M. Christensen, R.R. 2, Bethel, Vt. 05032; Samuel B. McGuire, 915 N. El Paso, Fountain, Colo. 80817

[21] Appl. No.: 173,336

[22] Filed: Dec. 27, 1993

[51] Int. Cl.[5] ..... B21D 7/04

[52] U.S. Cl. ..... 72/157; 72/159; 72/150; 72/369

[58] Field of Search ..... 72/150, 157, 159, 154, 72/149, 307, 321, 320, 369, 387

[56] References Cited

U.S. PATENT DOCUMENTS

| | | | |
|---|---|---|---|
| 4,691,555 | 9/1987 | Vaughan | 72/159 |
| 5,142,895 | 9/1992 | Schuchert | 72/150 |
| 5,187,963 | 2/1993 | Sutton, Jr. et al. | 72/159 |
| 5,284,041 | 2/1994 | Christensen | 72/157 |

FOREIGN PATENT DOCUMENTS

| | | | |
|---|---|---|---|
| 1384575 | 2/1975 | United Kingdom | 72/150 |

*Primary Examiner*—Daniel C. Crane

*Attorney, Agent, or Firm*—William R. Clark; Richard M. Sharkansky

[57] ABSTRACT

Method and apparatus for bending serpentine heat exchanger tubes using a split bend die having a relatively short upper die section with a straight back end. After the tube is bent in conventional manner using a clamp die and a pressure die, the bend die is split along a shaft and rotated through a predetermined angle to position the straight back end substantially parallel to a straight segment of the tube at the output of the bend die. The input segment of the tube is then moved next to the shaft in preparation for rotating above the input segment to raise the output segment above the upper section of the bend die. Such lateral motion reduces the segment spacing required for clearance of the upper section. Other features for reducing the spacing are providing an indentation on the shaft, angling the back end with respect to the sides to provide a minimum length, and truncation an upper portion along the back end.

24 Claims, 5 Drawing Sheets

METHOD AND APPARATUS FOR BENDING TUBES USING SPLIT BEND DIE

BACKGROUND OF THE INVENTION

The field of the invention generally relates to a method and apparatus for bending tubes such as for making heat exchangers, and more particularly relates to a split bend die and method of rotating the split sections of the bend die after bending a tube to reduce bend angles and vertical spacings between adjacent parallel segments of a tubular heat exchanger.

As is well known, residential furnaces have been constructed using tubular heat exchangers instead of the more conventional clam-shell heat exchangers. With such arrangement, a plurality of stainless steel or aluminized steel tubes are arranged within a heat exchange chamber of a furnace, and one end of each is fired by an individual burner. The hot combustion gases pass through the tubes, and heat is transferred to household return air that is forced across outside surfaces of the tubes.

In the above-described furnace arrangement, it is desirable to maximize the heat exchange surface area within the confined or restricted volume inside the heat exchange chamber. It may also be desirable to minimize the size, and in particular, the height of the heat exchange chamber so that the furnace can be used at installations that have height restrictions. Accordingly, tubes have been bent into serpentine configurations with parallel straight segments to increase the length of tubes that will fit into a heat exchange chamber. In particular, tubes have been rotated between successive bends so that the parallel straight segments are not linearly aligned. Thus, the bends can be seen to zigzag back and fourth when the parallel segments are viewed from their ends. The zigzagging is desirable because it promotes turbulence in household return air that is forced across the outside surfaces of the tubes. Thus, heat transfer is enhanced.

Another reason for zigzagging relates to the apparatus used to bend the tubes. In particular, one apparatus is described in U.S Pat. No. 5,142,895. A tube is seated in the groove of a rotary bend die, and a pressure die and clamp die are moved up against the opposite side of the tube. The bend die and the clamp die are then rotated approximately 180° about a vertical axis while the pressure die moves forward linearly carrying the tube tangentially to the bend point. The clamp die and pressure die are then retracted and returned to their respective initial positions, and the tube is repositioned with respect to the bend die so that another 180° bend can be made. The tube is also rotated to elevate the just formed segment above the path used by the clamp die on the next bend. This tube rotation leads to segments that zigzag rather than being disposed in a single plane. The apparatus used to split bend die wherein an upper section was elevated from a lower section to remove the tube which had been formed with controlled wrinkles past the 180° tangent point.

A later tube bending improvement is described in U.S. Pat. No. 5,284,041 filed May 10, 1993, which is hereby incorporated by reference. After bending the tube, the upper section of the bend die was independently rotated through a 90° angle about a vertical axis different than the bend die rotation axis. That is, after the upper and lower sections were rotated together about a first vertical axis to form a bend, the upper and lower sections of the bend die were split and then the upper section was independently rotated about a different axis. The independent rotation caused a portion of the upper section to be displaced laterally to vacate a region directly above the lower section. Then, when the tube was rotated to form a zigzag and/or moved forwardly to position for the next bend, a portion of the tube was permitted to pass through the vacated region. With such arrangement, the minimum bend angle between successive bends was less restricted than without rotating the upper section of the split bend die. For example, without rotating the upper section of the split bend die, the angle between successive bends or segments in the zigzag configuration had to be relatively large such as 108° to clear the upper section of the bend die. However, by rotating the upper section out of the way, smaller bend angles such as, for example, 60° could be formed. As a result, heat exchanger segments could be densely packed in a relatively low profile furnace.

One drawback of the above described arrangement is that a complicated mechanism using nonstandard designs or practices is generally required to rotate the upper section of the bend die independently. During a bending operation, the upper and lower bend die sections are locked together and rotated about a first axis. It then becomes a complicated mechanical task to lift the upper section and rotate it about a second axis.

SUMMARY OF THE INVENTION

It is an object of the invention to make successive bends of a tube such as for a heat exchanger, and to provide relatively small bend angles with relatively small center line radii to arrange parallel segments of the tube relatively close together in a zigzag pattern. By such arrangement, the parallel segments can be densely packed into a heat exchange chamber of restricted volume for optimal heat transfer.

It is a further object to limit the complexity of the bending equipment, and to use relatively conventional and standard mechanisms. For example, it is an object to avoid using an upper bend die that has a second axis of rotation different than the rotational axis used for the bending.

It is also an object to use a bend die that can be split, but the upper and lower sections are always in registration during bending and in preparing for a subsequent bend.

These and other objects and advantages are provided in accordance with the invention wherein a method of bending a tube first comprises a step of seating the tube tangentially in a tube groove of a bend die with a first portion of the tube extending forward from the bend die. The tube is clamped to the bend die using a clamp die. Then, the tube is moved tangentially toward the bend die with a pressure die while rotating the bend die and the clamp die to form a bend in the tube wherein the first portion extends rearwardly from the bend die substantially parallel with a second portion of the tube on the opposite side of the bend die. The above steps are conventional. The bend die is then split along a shaft into upper and lower sections, and the split sections are rotated in unison through a predetermined angle to position a substantially straight end of the upper bend die substantially parallel with the first portion of the tube. Relative motion is provided between the split bend die and the tube to position the second portion of the tube adjacent to the shaft. The tube is next rotated about the second portion to raise the first portion above the upper section of the bend die. The bend die sections are the closed and rotated back to their initial angular orientation, and the tube is moved relative to the bend die to position the tube for a subsequent bend.

Simply viewed, the relative motion between the split bend die and the tube positions the tube up against or next to the shaft, and reduces spacing between parallel segments that is required to clear the upper die section as the tube is moved in preparation for a subsequent bend. This process is mechanically simpler to implement than rotating the upper die section about an axis other than the rotational axis of the bed die to vacate a region above the lower die section. The result, however, is essentially the same in that relatively small bend angles and vertical spacings between parallel segments are achieved for dense packing of parallel heat exchanger segments.

In addition to providing relative motion between the tube and the split bend die sections, a number of other features may preferably be used to further limit the required spacing between parallel segments. For example, the upper bend die section preferably has a truncated upper portion along the substantially straight end; this feature enables the parallel segments to be closer because the tube can pass through the truncated portion as the tube is rotated about the second portion. Another preferable feature is that the sides of the bend die be of different lengths with the clamp die clamping the tube to the longer side. In particular, the side facing the clamp die should have a minimum length to properly mate with the clamp die, and the opposite side should have a minimum length to properly complete the bend. However, these two minimum lengths are different with the clamp requirement generally being longer. Therefore, by making each side only so long as generally required to perform its intended function, and forming the straight end of the upper bend die section at oblique angles to the sides, the straight end is made as close to the center of rotation as possible. Simply stated, the bend die is made as short as possible to further limit the parallel segment spacing that will clear the upper section as the tube is rotated. Another feature is that the shaft may comprise an indentation at the level to which the second portion is moved to be adjacent to the shaft. Therefore, the tube can be moved closer to the center of the shaft.

It is also preferable that the method further comprise a step of moving the tube forwardly before rotating the tube about the second portion. Also, it is preferable that the shaft extend through at least one of the bend die sections, and that the shaft be keyed to the one section to cause the shaft and the upper section to be rotated in unison and in response to the lower section being rotated.

The invention may also be practiced by tube bending apparatus comprising a bend die having opposing sides with respective tube grooves and a bend-forming end with a curved tube-groove extending between the tube grooves of the opposing sides to form a continuous tube groove adapted for receiving a tube while a bend is being formed, the bend die comprising upper and lower sections splitable along a shaft extending up through the lower section. A clamp die has a tube groove operative with one of the opposing sides of the bend die to clamp the tube in the tube groove of the one side. The apparatus also includes means for rotating the bend die through a first predetermined angle and moving the clamp die through an arc to maintain clamping of the tube with the one side of the bend die as the bend die is rotated to bend the tube. Means are also provided for retracting the clamp die from the one side of the bend die after the bend die has been rotated. The apparatus further includes means for rotating the upper and lower sections of the bend die in unison through a second predetermined angle to align a second end of the upper section with a straight segment on the tube on one side of the bend die. In accordance with the invention, also included is means for providing relative movement between the tube and the upper and lower sections of the bend die when the upper and lower sections are split to position the second segment of the tube adjacent to the shaft. Also included is means for rotating the tube about a second straight segment of the tube on the opposite side of the bend die to raise the first segment above the upper section.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 1:
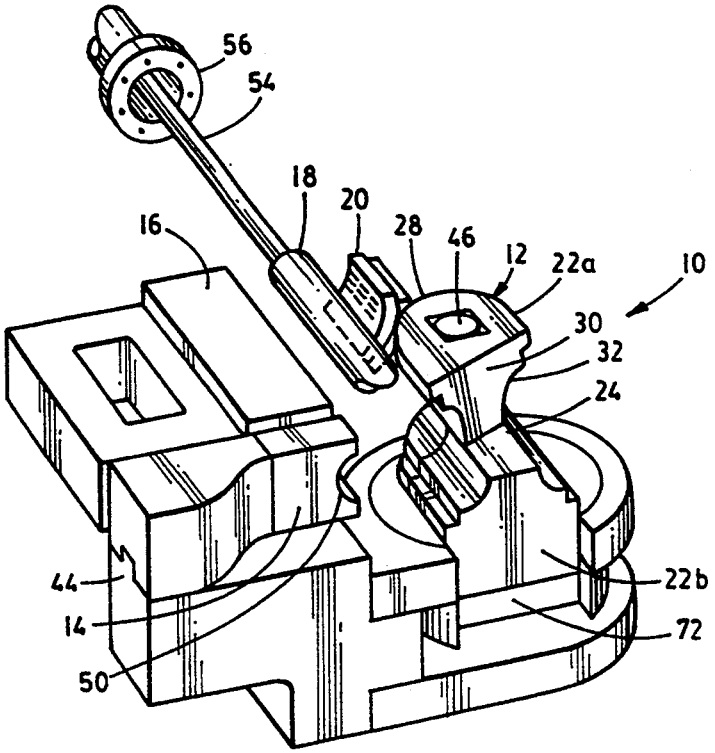
FIG. 1 is a perspective view of tube bending equipment in accordance with the invention.

Referring to FIG. 1, tube bending tooling 10 includes bend die 12, clamp die 14, pressure die 16, plastic plug mandrel 18 and plastic follower 20. As will be described in detail later herein, bend die 12 is a split die having upper and lower sections 22*a* and *b* which, as shown in FIG. 7, can be vertically separated at a mid portion 24. Also referring to FIGS. 5–9, bend die 12 has two opposing sides 26*a* and *b*, a bend forming end 28, and a substantially straight back end 30. Opposing sides 26*a* and *b* and bend forming end 28 have a continuous horizontal tube groove 32 that has generally elliptical curvature and is adapted for receiving a tube 34 of predetermined diameter such as 1.25 inches and predetermined wall thickness such as 0.035 inches as a bend is being formed. Bend forming end 28 is rounded and slightly larger than a semicircle, and opposing side 26a is straight and substantially tangent thereto. Side 26a functions as a grip section with clamp die 14, and therefore has a minimum suitable length such as 0.833 inches for performing this function. For reasons to be described in detail in accordance with the invention, side 26a of the upper section 22a is made as short as suitably possible, while the corresponding side 26a of the lower section 22b is preferably longer. The second opposing side 26b is also straight and tangent to bend-forming end 28. Because bend-forming end 28 is slightly greater than a semicircle, side 26b is angled inwardly such as by 7° from parallel with side 26a to provide an overbend to compensate for springback. Thus, after a bend has been formed in a manner to be described, output and input straight segments 62a and *b* of tube 34 are substantially parallel as desired. Side 26b generally has a minimum length such as 0.473 inches to properly complete a bend. For reasons to be described in detail in accordance with the invention, side 26a of the upper section 22b is made as short a suitably possible, while the corresponding side 26b of the lower section 22b is preferably longer. As has been described, side 26a of upper die section 22a is longer than side 26b because side 26a performs the function of gripping the tube 34 with clamp die 14. Thus, as shown best in FIGS. 6 and 8, back end 30 is oblique to sides 26a and *b*, and has a minimum spacing to the axis of rotation 38 of bend die 12. Still referring to FIG. 9, upper bend die section 22a has a truncated upper portion 40 along back end 30. Tube groove 32 here has a plurality of vertically elongated controlled-wrinkle indentations 42 or serrations that are disposed in an arc greater than 180°.

Bend die 12 is mounted to a conventional rotary arm 44 such that bend die 12 can be rotated during a bending operation. In particular, as shown best in FIG. 5, a keyed shaft 46 such as a square shaft 46 passing up through a corresponding square bore 48 is securely affixed to upper bend die section 22a. Thus, as lower section 22b is rotated with rotary drive arm 44, upper section 22a is correspondingly driven by shaft 46.

Clamp die 14 and pressure die 16 have respective linear tube grooves 50 and 52 (FIG. 3) that may preferably be elliptically shaped and adapted to receive a tube 34. Initially, pressure die 16 and clamp die 14 are lined side by side with tube grooves 50 and 52 linearly aligned, and they are spaced from the axis defined by side 26a as shown in FIG. 1. A plastic follower 20 having an arcuate surface generally conforming to the outer diameter of the tube 34 being bent is mounted behind the bend die 12 diametrically opposite pressure die 16. A mandrel rod 54 with a plastic plug mandrel 18 on the end extends forwardly with bend die 12 and plastic follower 20 on one side, and pressure die 16 and clamp die 14 on the opposite side. Supporting and drive mechanisms for bend die 12, pressure die 16, clamp die 14, mandrel rod 54 and plastic follower 20 are not described in detail herein because they are conventional, and an explanation of them is not necessary for an understanding of the invention.

Figure 2:
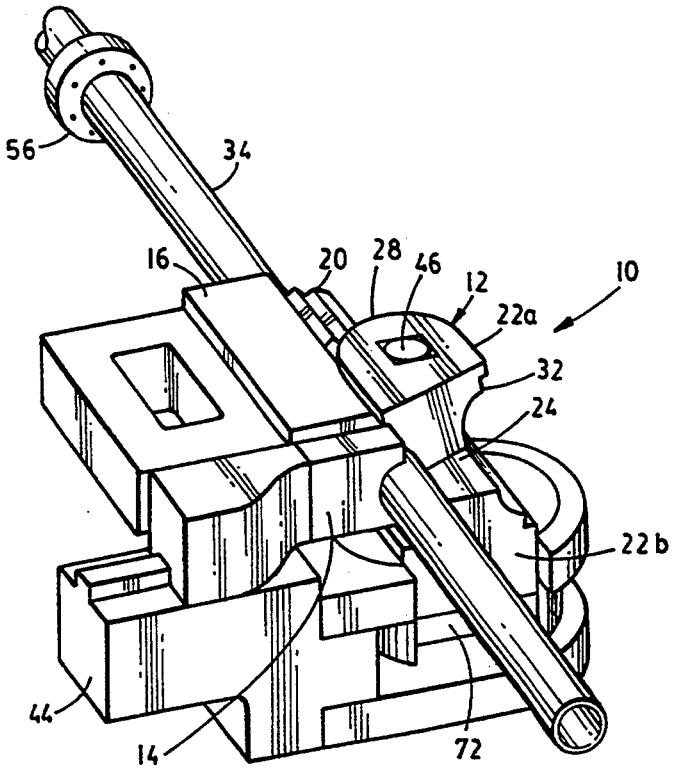
FIG. 2 is a perspective view of a tube positioned in the equipment of FIG. 1 at the commencement of a bending operation.
Figure 5:
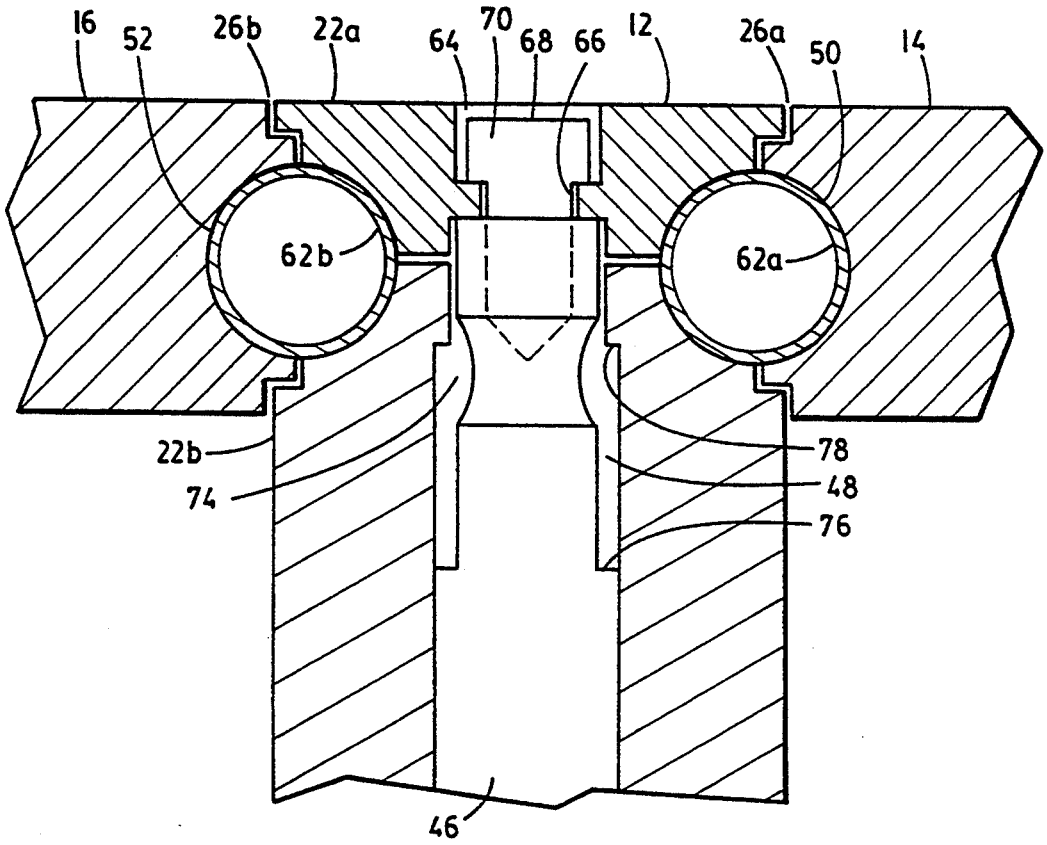
FIG. 5 is a partially sectioned front view of the bend die, clamp die and pressure die after completion of a bend.

Referring to FIG. 2, the first step in a bending operation is to insert tube 34 onto mandrel rod 54. Tube 34 is held in place there by collet 56. Pressure die 16 and clamp die 14 are then moved laterally to engage tube 34 as shown. In particular, clamp die 14 is moved diametrically opposite side 26a of bend die 12 and mates therewith. The mating portion 58 of clamp die 14 may be unconventionally short because, as described earlier, the corresponding side 26a of upper bend die 12 has a minimum length such as, for example, 0.833 inches. Clamp die 14 and the grip section of side 26a are interlocked, and tube 34 is firmly clamped therebetween. In FIG. 5, face edges of clamp die 14 can be seen to seat in mating channels of bend die 12. Alternately, face portions of clamp die 14 and bend die 12 can be mated or interlocked using a tongue and groove arrangement to reduce the profile of bend die 12. As will be apparent later herein, a bend die of lower profile enables the use of smaller angles between consecutive bends. Similarly, the portion of tube 34 immediately behind clamp die 14 is received in tube groove 52 of pressure die 16. Lateral pressure exerted on tube 34 by pressure die 16 is restrained by plastic follower 20.

Figure 3:
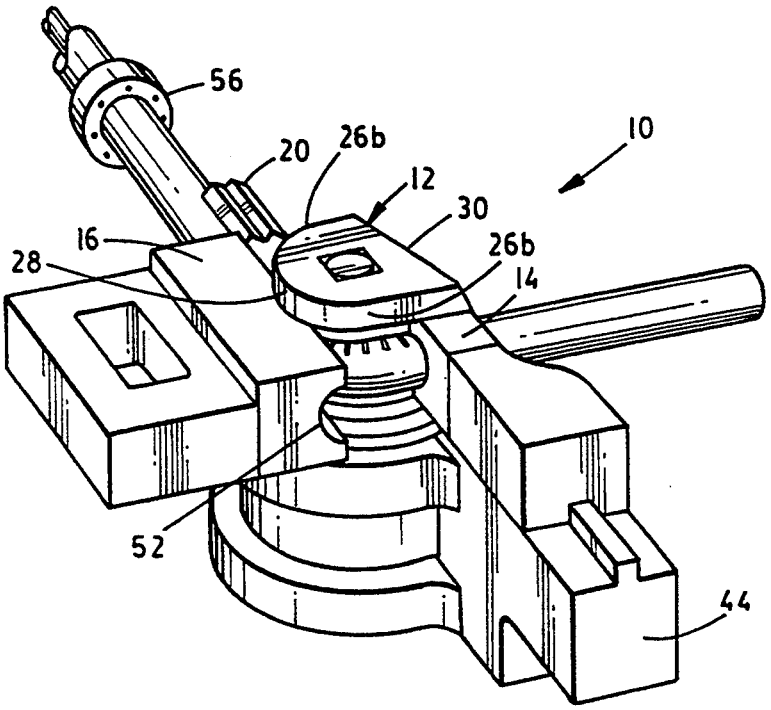
FIG. 3 is a perspective view of the equipment of FIG. 2 at an intermediate stage of bending.
Figure 8:
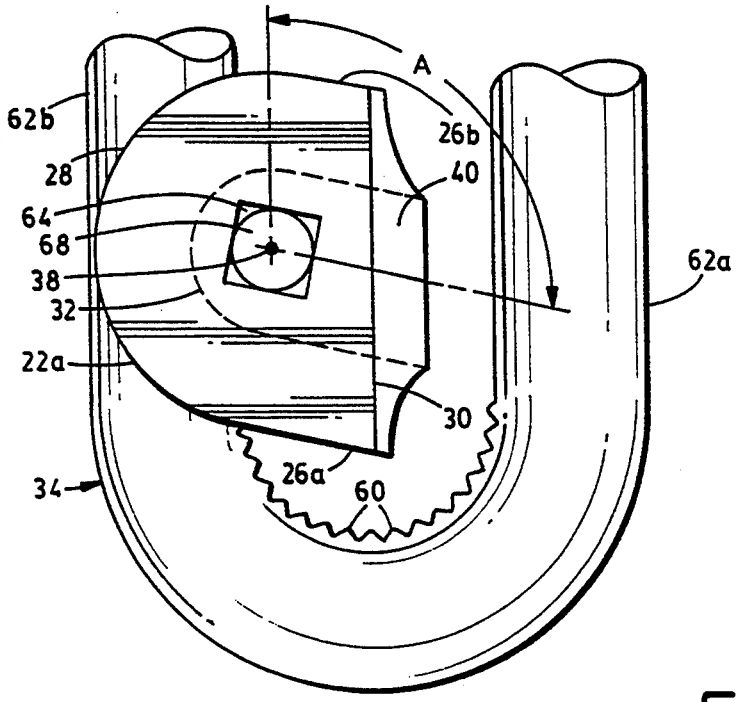
FIG. 8 is a top view after the tube has been moved forward and the bend die has been rotated through a predetermined angle A.

Referring to FIG. 3, bend die 12 and clamp die 14 are rotated in unison while pressure die 16 drives linearly forward. Tube 34, which remains held by collet 56, is driven forwardly to the tangent or bend point of die 12. Plastic follower 20 has a relatively low coefficient of friction such that tube 34 readily slides over it while plastic follower 20 continues to restrain the pressure of pressure die 16. During a bending operation, tube 34 continues to be clamped between clamp die 14 and die side 26a as clamp die 14 is driven through a corresponding arc by a suitable rotating arm 44. As tube 34 bends around rotating bend die 12, the inside of the tube bend is compressed and the metal flows into the elongated vertical serrations 42 thereby forming controlled-wrinkles 60 as shown in FIG. 8.

Figure 4:
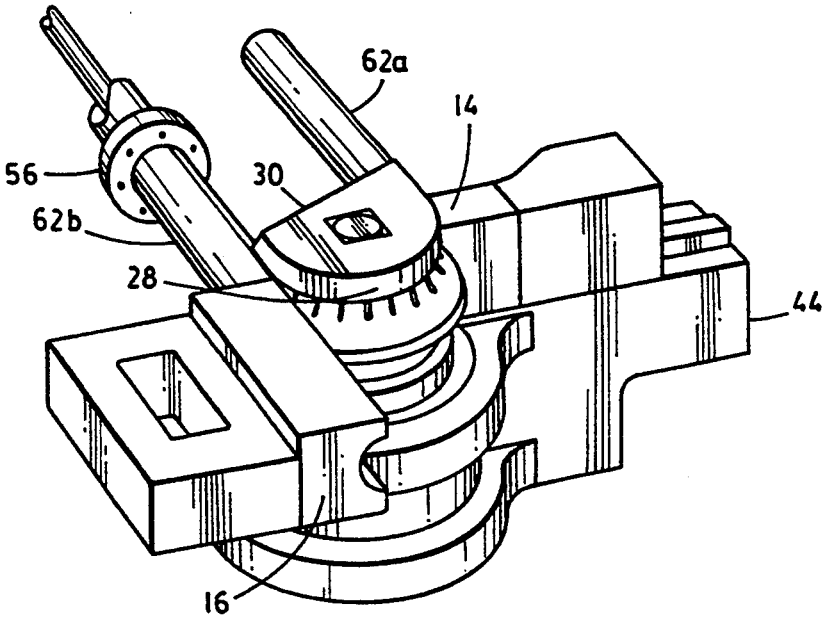
FIG. 4 is a perspective view of the equipment of FIG. 2 after completion of a bending operation and before the tube is repositioned for a subsequent bending operation of the tube.

Referring to FIG. 4, tube 34 is shown after it has been bent a full 180° such that straight output segment 62a is substantially parallel with a straight input segment 62b extending from collet 56. Actually, bend die 12 is rotated slightly more than 180° such that segment 62a and *b* will be substantially parallel when they spring back. In such state, bend die 12 has rotated approximately 180° from the initial angular orientation, and likewise clamp die 14 has moved through an approximate 180° arc about the central axis of rotation 38 such that tube groove 50 now faces in the opposite direction from the initial orientation, and still clamps tube 34 to side 26a of bend die 12. Also, pressure die 16 is shown to have linearly traversed to its forward-most position where it still engages tube 34 at its tangent point to bend die 12. During the entire bending operation, plastic plug mandrel 18 remains in a stationary position within tube 34, and thereby functions to limit or control the collapse of tube 34. More specifically, plastic plug mandrel 18 does not advance around the bend as a multiple ball mandrel would, but rather remains stationary with its tip being in the approximate region of the tangent or bend point. Plastic mandrel 18 is subject to wear that particularly occurs on the outside as the wall of tube 34 slides against it, but plastic plug mandrels 18 are relatively inexpensive to replace. As the plastic wears, the plastic plug mandrel 18 is moved slightly forward by a simple adjustment so that the tip remains properly positioned to control collapse to the desired degree. In an alternate embodiment, tubes 34 may be bent without using a plastic plug mandrel 18 or any other internal supporting structure. In other words, tubes 34 can be bent without any collapse suppressing structure on the inside. Also, tubes 34 can be bent without a bend die 12 having elongated serrations 42 to provide controlled-wrinkles 60. This concludes the description of a single bending operation.

Referring to FIG. 5, a partially sectioned view shows bend die 12 at the completion of a bending operation. In particular, pressure die 16 is shown at the left or input side and clamping die 14 is shown at the right or output side of bend die 12. As shown, shaft 46 extends through bore 48 in the lower section 22*b* and is secured to the upper section 22*a*. More specifically, upper section 22*a* has a bore 64 with a annular ring 66 or ledge, and a fastening member 68 with a head 70 passes down through bore 64 and is secured into the top of shaft 46. The head 70 seats against the annular ring 66 to securely affix upper section 22*a* to shaft 46. The shaft 46 below ring 66 is keyed to bore 64 to provide registration between upper and lower sections 22*a* and *b*.

Figure 6:
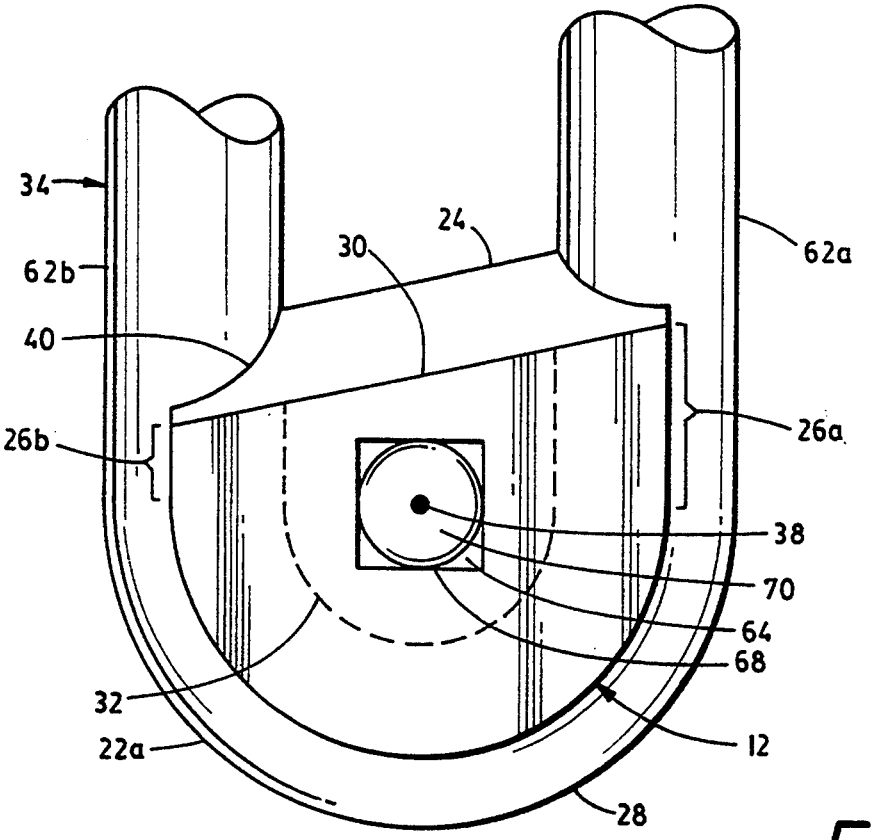
FIG. 6 is a top view of the bend die after retraction of the clamp die and pressure die after completion of a bend.
Figure 7:
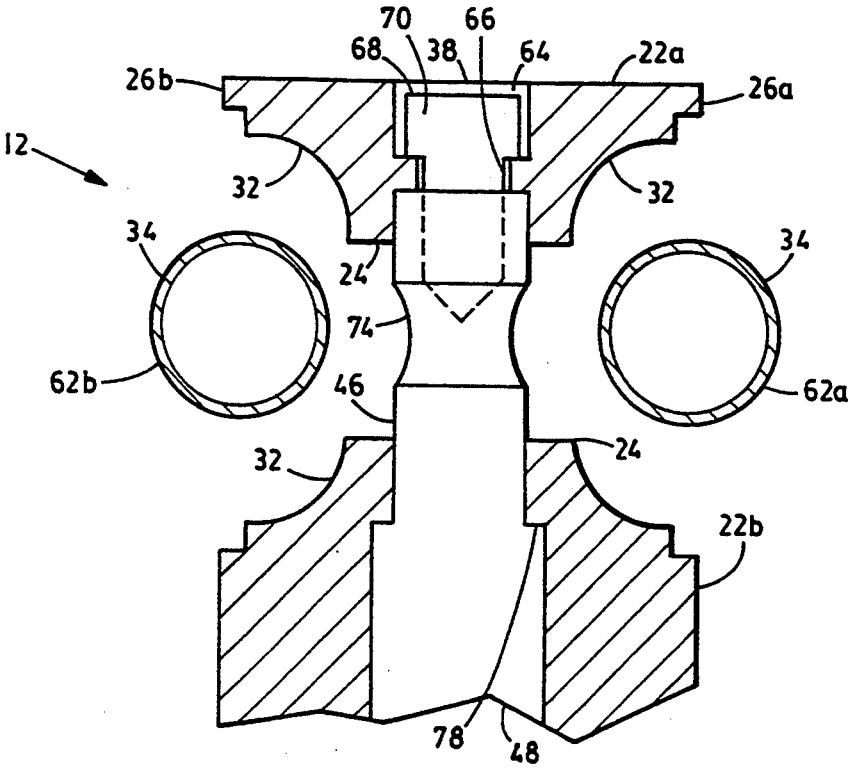
FIG. 7 is a partially sectioned front view of the bend die after being split.

Referring to FIG. 6 and 7, top and partially sectioned front views of bend die 12 are shown after bend die 12 has been split into upper and lower sections 22*a* and *b*. As shown here, collet 56 holds tube 34 at its present level after bending, and upper section 22*a* is raised by elevating shaft 46 using a suitable mechanism. Further, lower section 22*b* is lowered into a keyway 72 of rotary arm 44 as shown in FIG. 1 to position tube 34 substantially at a mid-level between upper and lower sections 22*a* and *b*. A shoulder 76 of shaft 46 contacts a lip 78 of bore 48 to insure precise alignment. Such action may be implemented using a suitable mechanism (not shown) such as a double action cylinder wherein the plunger or shaft 46 is raised while the outer cylinder or lower section 22*b* is lowered. Alternatively, lower section 22*b* or upper section 22*a* could be held stationary while the other section 22*a* or *b* is separated or split therefrom, and then tube 34 could be moved vertically by collet 56 to a mid-level therebetween. For reasons to be described subsequently, the under surface of upper section 22*a* is spaced from the top surface of lower section 22*b* by a distance larger than the outer diameter of tube 34. For example, when the outer diameter of tube 34 is, for example, 1.25 inches, upper and lower sections 22*a* and *b* may preferably be split or separated by 1.38 inches.

Figure 9:
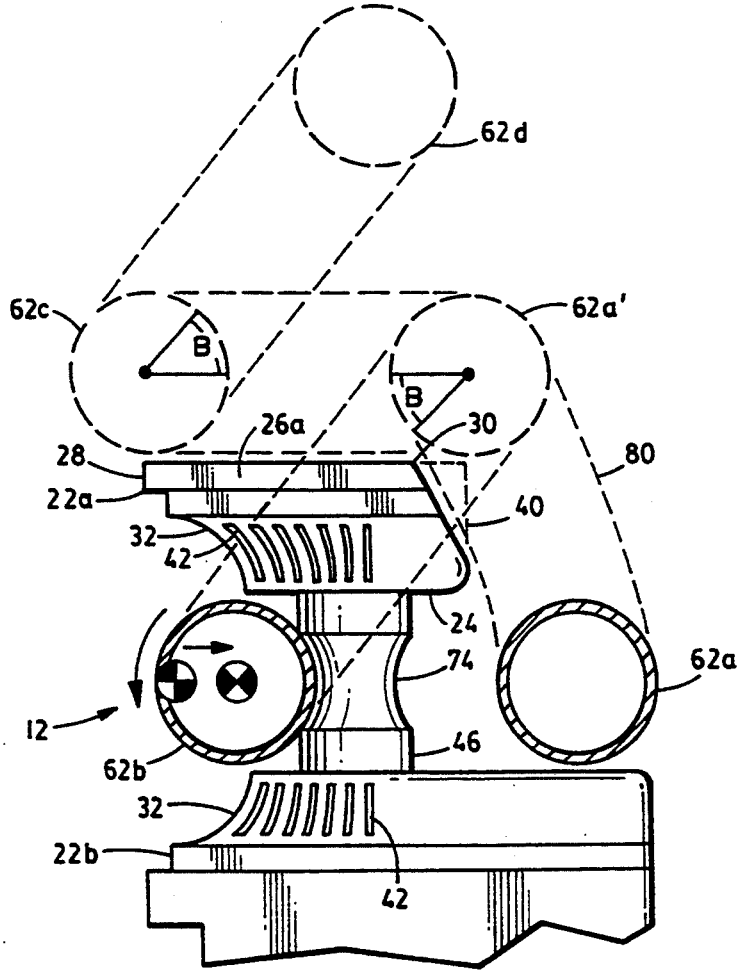
FIG. 9 is a front view of the spit bend die with the tube positioned in accordance with the invention for rotation about an input segment.

The next steps in preparing for a subsequent bend of tube 34 is for collet 56 to move tube 34 forwardly as shown in FIG. 8 and laterally as shown in FIG. 9. The forward motion of tube 34 moves tube 34 out of tube groove 32 so that straight output segment 62*a* of tube 34 may be rotated up and over upper section 22*a* in a manner to be described. Alternate to moving tube 34 laterally as shown in FIG. 9, the split sections 22*a* and *b* of bend die 12 may be moved laterally to tube 34. The important function is that there be relative motion between tube 34 and sections 22*a* and *b* of split bend die 12 to position the input straight segment 62*b* of tube 34 adjacent or next to shaft 46 so that the input straight segment 62*b* can be as close as possible to the output straight segment 62*a* and still have the output segment 62*a* clear the upper section 22*a* as tube 34 is rotated about input segment 62*b* in a manner to be described. As described earlier herein, shaft 46 is square to key shaft 46 to upper section 22*a* and lower section 22*b*. However, indentation portion 74 is located at the height of tube segment 62*b* which here is the mid-level between upper and lower sections 22*a* and *b* as shown in FIG. 9. Indentation portion 74 is here circular with upper and lower transition regions from square to circular and visa versa, respectively. By such arrangement, input straight segment 62*b* is positioned closer to the center of shaft 46 to further reduce the required spacing between input straight segment 62*b* and output straight segment 62*a* that will clear upper section 22*a* as tube 34 is rotated about input segment 62*b*.

Referring to FIG. 8, the next step in preparing to make a subsequent bend is rotating upper section 22*a*, as well as lower section 22*b* which for simplicity is not shown in FIG. 8, through a predetermined angle A about the axis of rotation 38 of bend die 12 to position the straight back end 30 of the upper section 22*a* substantially parallel to the output straight segment 62*a* of tube 34. As described earlier, straight back end 30 is oblique to sides 26*a* and *b*, so angle A would typically be other than 90°. In particular, angle A would typically be in the range from 100° to 120° depending on the parameters of upper section 22*a*, and rotation would be counter to the bending direction.

Referring to FIG. 9, the next step in positioning tube 34 for a subsequent bend is to rotate the collet 56 to rotate tube 34 about the axis of the straight input straight segment 62*b* to raise the output segment 62*a* above upper section 22*a* of bend die 12. As output segment 62*a* is raised by rotation of tube 34 about input segment 62*b*, output segment 62*a* passes through the truncated portion 40. In particular, the envelope 80 in moving segment 62*a* to position 62*a*′ is shown passing through truncated portion 40. In such manner, the required spacing between input segment 62*b* and output segment 62*a* is further reduced by cutting off or truncating an upper portion 40 of upper section 22*a*. In a preferred embodiment, truncated portion 40 is angled at 15° from vertical. By such arrangement, a tube with an outer diameter of 1.25 inches may be bent with a center line radius of 1.5 inches, and the bend angles B between adjacent straight segments, here shown as segments 62*b*, 62*a*′, 62*c*, and 62*d*, may typically be in the range from 48° to 60°.

In summary, the upper bend die section 22*a* is made relatively short, and after splitting the bend die 12, is rotated in unison with the lower bend die section 22*b* until the back end 30 of the upper section 22*a* is substantially parallel with the straight segment 62*a* of the tube 34 at the output side of the bend die 12. Relative motion is provided to position the straight segment 62*b* at the input side of the bend die 12 adjacent or next to shaft 46. By such action, input and output sections 62*a* and *b* can be made closer together and still have output segment 62*a* clear upper section 22*a* as tube 34 is rotated about input segment 62*b*. Some combination of a plurality of other features may be combined to further reduce the center line radius or spacing between two consecutive segments identified as input segment 62*b* and output segment 62*a* as shown best in FIG. 9. First, even though shaft 46 is keyed to cause rotation of bend die sections 22*a* and *b* in unison and thereby simplify the rotating mechanisms, shaft 46 has an indentation portion 74 to locate the input segment 62*b* closer to the center of shaft 46. Second, upper section 22*a* is made relatively short from bend-forming end 28 to the back end 30. More particularly, the distance from the center axis 38 of rotation of shaft 46 to back end 30 is minimized. Side 26*a* has to be relatively long to provide clamping with clamp die 14, but side 26*b* can be made relatively short while having enough length to complete a bend. Thus, back end 30 is angled to be as close as possible to the center of shaft 46 while still enabling the required functions to be performed. Finally, the upper portion 40 along the upper edge of back end 30 is truncated. By combining these described features, a radius of 2.375 can be provided between the center of input segment 62*b* and output segment 62*a* to clear upper section 22*a* with a tube having a diameter of 1.25 inches.

To complete the steps in preparation for making another bend, collet 56 moves tube 34 out from in-between upper and lower sections 22*a* and *b*, and moves tube 30 forwardly to position the next desired bend location of tube 34 adjacent to bend die 12. As can be seen from FIG. 9, if one or more bends had previously been made in a process to form a serpentine heat exchanger with zigzag parallel segments 62*b*, 62*a*', 62*c*, and 62*d*, the segments and bends would clear bend die 12. The final steps are to close bend die sections 22*a* and *b* back together and rotate bend die 12 back to its initial angular orientation as shown in FIG. 1. Clamp die 14 and pressure die 16 are also repositioned in their respective initial locations in preparation for making another bend.

With the bending apparatus and method described heretofore, relatively tight bends such as bends having a center line radius with 1.25 inch tube 34 can be made using relatively standard tube bending equipment. For example, other than positioning and rotating the tube 34 using collet 56, the only nonstandard equipment is a mechanism to lift shaft 46 to raise upper section 22*a* while lowering lower section 22*b*. The rotation of upper and lower sections 22*a* and 22*b* to the angular orientation as shown in FIG. 8 is accomplished merely by programming rotary arm 44 to stop momentarily after rotation back through predetermined angle A. The apparatus and method simplified the prior art actuation mechanism by eliminating the need to rotate the upper section 22*a* independent of upper section 22*b*.

This completes the Description of the Preferred Embodiment. A reading of it by those skilled in the art will bring to mend many alterations and modification that do not depart from the spirit and scope of the invention. Therefore, it is intended that the scope of the invention be limited only by the appended claims.

What is claimed is:

1. A method of bending a tube comprising the steps of:

seating said tube tangentially in a tube groove of a bend die with a first portion of the tube extending forward from the bend die;

clamping said tube to said bend die with a clamp die;

moving said tube tangentially toward said bend die with a pressure die while rotating said bend die and said clamp die to form a bend in said tube wherein said first portion extends rearwardly from said bend die substantially parallel with a second portion of said tube on the opposite side of said bend die;

splitting upper and lower sections of said bend die along a shaft;

rotating said upper and lower bend die sections in unison through a predetermined angle to position a substantially straight end of said upper bend die substantially parallel with said first portion of said tube;

providing relative motion between said tube and said split bend die to position said second portion of said tube adjacent said shaft;

rotating said tube about said second portion to raise said first portion above said upper bend die section;

closing said bend die sections back together and rotating said bend die back to its initial angular orientation; and moving said tube relative to said bend die to position said tube for a subsequent bend.

2. The method recited in claim 1 further comprising a step of moving said tube forwardly before rotating said tube about said second portion.

3. the method recited in claim 1 wherein said shaft is secured to said upper section, and extends through and is keyed to said lower section to cause said upper section to rotate in response to and in unison with rotation of said lower section.

4. The method recited in claim 1 wherein said upper section of said bend die has a truncated upper portion along said substantially straight end.

5. The method recited in claim 4 wherein said first portion of said tube passes through said truncated portion as said tube is rotated about said second portion.

6. The method recited in claim 1 wherein said bend die has opposing sides and a bend-forming end substantially opposite said substantially straight end, said opposing sides being different lengths where in said clamp die clamps said tube to the longer one of said opposing sides.

7. The method recited in claim 1 wherein said shaft comprises an indentation at a level to which said second portion is moved to be adjacent to said shaft.

8. The method recited in claim 1 wherein said predetermined angle is between 90° and 120°.

9. A method of bending a tube, comprising the steps of:

providing a bend die having opposing sides with respective tube grooves and a bend-forming end with a curved tube groove extending between the tube grooves of the opposing sides to form a continuous tube groove adapted for receiving a tube while a bend is being formed, the bend die comprising upper and lower sections splitable along a shaft extending up through at least one of the sections, the upper section having a second end with an upper truncated portion;

providing a clamp die having a tube groove operative with one of the opposing sides of the bend die to clamp the tube in the tube groove of the one side in preparation for bending the tube;

rotating the bend die through a first predetermined angle and moving the clamp die through a corresponding arc to maintain clamping of the tube with the one side of the bend die as the bend die is rotated to bend the tube;

retracting the clamp die from the one side of the bend die after the bend die has been rotated;

rotating the upper and lower sections through a second predetermined angle less than the first predetermined angle to align the second end of the upper section with a straight segment of the tube on one side of the bend die; and rotating the tube about a second straight segment of the tube on the side opposite the one side of the band die to pass the first straight segment through the truncated portion of the upper bend die as a step in positioning the tube in preparation for a subsequent bending operation.

10. The method recited in claim 9 further comprising a step of providing relative motion between the tube and the split upper and lower sections of the bend die to position the second straight segment of the tube adjacent the shaft before rotating about the second straight segment.

11. The method recited in claim 9 further comprising a step of moving the tube forwardly before rotating the tube about the second straight segment.

12. The method recited in claim 9 wherein the shaft is keyed to the at least one section through which the shaft extends to cause the opposite section to rotate in unison with at least one section.

13. The method recited in claim 9 wherein one of the opposing sides of the bend die is longer than the other, and the clamp die clamps the tube in the tube groove of the longer one of the opposing sides.

14. The method recited in claim 9 wherein the first predetermined angle is approximately 180° in one direction and the second predetermined angle is approximately 115° in the opposite direction.

15. Tube bending apparatus comprising:

a bend die having opposing sides and a bend-forming end extending between the opposing sides, the bend-forming end and the opposing sides having a continuous tube groove adapted for receiving a tube while a bend is being formed;

a clamp die having a tube groove operative with one of the opposing sides of the bend die to clamp the tube in the tube groove of the one side, the clamp die being moveable through an arc to maintain clamping of the tube with the one side of the bend die as the bend die is rotated through a predetermined angle to bend the tube, the clamp die being retractable from the one side of the bend die after rotation of the bend die; and the bend die comprising upper and lower sections splitable along a shaft extending through at least one of the sections, the upper section having a second end with a truncated upper portion means for splitting and rotating both, the upper and lower sections are split and rotated through a second predetermined angle less than the first predetermined angle to align the second end with a first straight segment of the tube on one side of the bend die and means for rotating the tube about a second straight segment of the tube on the opposite side of the bend die with the first straight segment passing through the truncated portion of the upper bend die in preparation for a subsequent bend.

16. The tube bending apparatus recited in claim 15 wherein the one side of the upper section is longer than the opposing side forming oblique angles between the second end and the respective opposing sides.

17. The tube bending apparatus recited in claim 15 further comprising means for providing relative movement between the tube and the upper and lower sections of the bend die when the upper and lower sections are split to position the second segment of the tube adjacent to the shaft.

18. The tube bending apparatus recited in claim 15 wherein the shaft is keyed to the at least one section through which the shaft passes to cause the opposite section to rotate in unison in response to rotation of the one section.

19. The tube bending apparatus recited in claim 18 wherein the keyed shaft has an indentation adjacent to the second segment of the tube after relative movement to position the second segment closer to the center of the shaft.

20. Tube bending apparatus comprising:

a bend die having opposing sides with respective tube grooves and a bend-forming end with a curved tube groove extending between the tube grooves of the opposing sides to form a continuous tube groove adapted for receiving a tube while a bend is being formed, the bend die comprising upper and lower sections splitable along a shaft extending up through the lower section;

a clamp die having a tube groove operative with one of the opposing sides of the bend die to clamp the tube in the tube groove of the one side;

means for rotating the bend die through a first predetermined angle and moving the clamp die through an arc to maintain clamping of the tube with the one side of the bend die as the bend die is rotated to bend the tube;

means for retracting the clamp die from the one side of the bend die after the bend die has been rotated;

means for rotating the upper and lower sections in unison through a second predetermined angle less than the first predetermined angle to align a second end of the upper section with a straight segment of the tube on one side of the bend die;

means for providing relative movement between the tube and the upper and lower sections of the bend die when the upper and lower sections are split to position the second segment of the tube adjacent to the shaft; and means for rotating the tube about a second straight segment of the tube on the opposite side of the bend die to move the tube to a position in preparation for a subsequent bending operation.

21. The tube bending apparatus recited in claim 20 wherein the one side of the upper section is longer than the opposing side forming oblique angles between the second end and the respective opposing sides.

22. The tube bending apparatus recited in claim 20 wherein the second end of the upper section has a truncated upper portion, and the first straight segment passes through the truncated portion as the tube is rotated about the second straight segment.

23. The tube bending apparatus recited in claim 20 wherein the shaft is keyed to the lower section to cause the upper section to rotate in unison with the lower section.

24. The tube bending apparatus recited in claim 23 wherein the keyed shaft has an indentation adjacent to the second straight segment of the tube after relative movement to position the second segment closer to the center of the shaft.

* * * * *